US010544984B2

(12) United States Patent
Park et al.

(10) Patent No.: US 10,544,984 B2
(45) Date of Patent: Jan. 28, 2020

(54) REFRIGERATOR

(71) Applicant: LG ELECTRONICS INC., Seoul (KR)

(72) Inventors: Yoomin Park, Seoul (KR); Heonjae Jang, Seoul (KR); Jinho Son, Seoul (KR)

(73) Assignee: LG Electronics Inc., Seoul (KR)

( * ) Notice: Subject to any disclaimer, the term of this patent is extended or adjusted under 35 U.S.C. 154(b) by 85 days.

(21) Appl. No.: 15/592,532

(22) Filed: May 11, 2017

(65) Prior Publication Data

US 2017/0328627 A1 Nov. 16, 2017

(30) Foreign Application Priority Data

May 12, 2016 (KR) ..... 10-2016-0058424

(51) Int. Cl.
*F25D 23/02* (2006.01)
*F25D 11/02* (2006.01)
*F25D 25/02* (2006.01)

(52) U.S. Cl.
CPC ..... *F25D 23/028* (2013.01); *F25D 11/02* (2013.01); *F25D 25/022* (2013.01); *F25D 2323/021* (2013.01)

(58) Field of Classification Search
CPC .. F25D 25/022; F25D 2323/021; F25D 11/02; F25D 23/028; F25D 23/04
USPC ..... 312/405.1, 408
See application file for complete search history.

(56) References Cited

U.S. PATENT DOCUMENTS 200,773 A * 2/1878 Smith
716,852 A * 12/1902 Baker
2,767,951 A * 10/1956 Cousino ..... A47B 57/54 248/245
3,356,328 A * 12/1967 Sachau ..... A47B 57/56 248/245
4,170,335 A * 10/1979 King ..... A47B 57/567 248/246

(Continued)

FOREIGN PATENT DOCUMENTS

CN 102313433 1/2012
EP 2843333 3/2015

(Continued)

OTHER PUBLICATIONS

Extended European Search Report in European Application No. 17170309.3, dated Jul. 17, 2017, 9 pages (with English translation).

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator includes a cabinet that defines a storage space, a door configured to open and close at least a portion of the storage space, a door dike protruding from a rear surface of the door toward the storage space along a circumference of the rear surface of the door, and a guide groove defined at an inside surface of the door dike. The refrigerator also includes a plurality of fixing grooves recessed from a first inner surface of the guide groove and vertically spaced apart from each other, a receiving member configured to mount to the door dike, and a restricting member located at an outside surface of the receiving member.

20 Claims, 8 Drawing Sheets

(56) References Cited

U.S. PATENT DOCUMENTS

| | | | | |
|---|---|---|---|---|
| 4,911,393 | A * | 3/1990 | Alperson | A47B 57/56 248/246 |
| 8,757,743 | B2 * | 6/2014 | Wilson | A47B 57/045 108/108 |
| 9,518,776 | B2 * | 12/2016 | Baldo | F25D 25/02 |
| 9,752,821 | B2 * | 9/2017 | Seeley | F25D 25/024 |
| 2004/0255607 | A1 * | 12/2004 | Barmann | A47B 57/562 62/407 |
| 2010/0175414 | A1 * | 7/2010 | Kim | F25D 23/04 62/377 |
| 2010/0326122 | A1 | 12/2010 | Seo et al. | |
| 2012/0293056 | A1 * | 11/2012 | Kim | F25D 23/04 312/405.1 |
| 2017/0191740 | A1 * | 7/2017 | Jung | A47B 88/477 |

FOREIGN PATENT DOCUMENTS

| | | |
|---|---|---|
| KR | 10-2010-0138098 | 12/2010 |
| KR | 10-2015-0045749 | 4/2015 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2016-0058424, filed in Korea on May 12, 2016, which is hereby incorporated by reference in its entirety.

BACKGROUND

The present disclosure relates to a refrigerator.

In general, a refrigerator is a home appliance that can store foods at a low temperature in an internal storage space shield by a door. The refrigerator cools the inside of the storage space using cool air generated through heat exchanging with a refrigerant that circulates a refrigerating cycle, to store the foods in an optimum state.

As dietary life changes and tastes of users are diversified, the size of the refrigerator tends to increase more and more and multi-functions are provided to the refrigerator. Accordingly, refrigerators provided with various structures and convenience devices for convenience of user and freshness of stored foods are brought to the market.

Shelves, drawers, baskets, and the like are provided at the inside of such a refrigerator and the rear surface of a door to store various foods in a freezing state or a refrigerating state. Meanwhile, shelves, baskets, and the like, which are provided in the refrigerator or at the door, are categorized according to sizes of foods to be mounted at desired positions, so that spaces in the refrigerator can be efficiently used according to stored foods.

However, in order to control heights of the shelves and baskets in a state in which foods are stored in the shelves and baskets, all of the foods are carried out, the shelves and baskets are separated and again mounted at desired positions, and then the foods are again stored in the shelves and the baskets, which is complicated.

In order to solve such a problem, there has recently been developed a refrigerator configured to control heights of shelves and baskets in a state in which the shelves and baskets are mounted, thereby improving use convenience.

Korean Patent Publication 10-2010-0138098 discloses a related art in which a receiving member mounting part having a guide groove and a fixing groove is formed at a door rim, a guide projection moved along the guide groove and a fixing projection selectively inserted into the fixing groove by rotation of a receiving member are provided at both side surfaces, so that the receiving member can be moved vertically and fixed.

Meanwhile, in the structure described in the related art, the receiving member may drop as the fixing projection is separated from the fixing groove due to the movement of the receiving member. That is, the fixed position of the receiving member cannot be stably maintained, and therefore, a user may feel anxiety. In addition, decay of foods and injury of the user may occur due to the drop of the receiving member.

SUMMARY

Embodiments provide a refrigerator including a receiving member that can be easily moved vertically and restricted along a rear surface of a door by a rotating manipulation.

Embodiments also provide a refrigerator in which a receiving member can be returned to a restriction state without any separate manipulation in a state in which the restriction of the receiving member is released.

Embodiments also provide a refrigerator that enables a restriction state of a receiving member to be stably maintained.

In one embodiment, a refrigerator includes: a door opening/closing a storage space in which a cabinet is formed; a door dike protruding along the circumference of a rear surface of the door; a guide groove extending in the top-bottom direction at the door dike; a plurality of fixing grooves extending in a direction intersecting the guide groove in the guide groove, the plurality of fixing grooves being vertically spaced apart from each other; a receiving member mounted to the door dike to be rotatable and movable up and down; and a restricting member provided at each of both sides of the receiving member, the restricting member being moved along the guide groove, wherein the restricting member includes: a rotational center part protruding from the receiving member to be inserted into the guide groove, the rotational center part serving as a rotational center of the receiving member; a fixing part protruding from one side spaced apart from the rotational center part, the fixing part being selectively inserted in the fixing groove as the receiving member is rotated; and an elastic part protruding in the opposite direction to the fixing part to be elastically deformed in the rotation of the receiving member, the elastic part providing an elastic force such that the fixing part is inserted into the fixing groove.

The elastic part may be pressurized in contact with an inner surface of the guide groove, and maintain a state in which the fixing part is inserted into the fixing groove.

When the receiving member is rotated, the elastic part may be pressurized by the inner surface of the guide groove to be elastically deformed. When the elastic part is elastically deformed, the fixing part may be separated from the fixing groove to be located at the inside of the guide groove.

The restricting member may include a rib-shaped extension part extending vertically. The rotational center part and the fixing part may be formed at upper and lower ends of the extension part, respectively.

The extension part may be in surface contact with the inner surface of the guide groove in the state in which the fixing part is inserted into the fixing groove.

The elastic part may extend in the opposite direction to the fixing part from one side of the extension part, and extend in a direction distant from the rotation center part.

The elastic part may include: a first part extending downwardly inclined to the front from a front surface of the extension part; a second part extending downwardly inclined to the rear from a lower end of the first part; and a round part formed rounded at a portion at which the first part and the second part are in contact with each other, the round part being in contact with the inner surface of the guide groove.

The elastic part may be formed in a rib shape, and be spaced apart from a side surface of the receiving member to form a space part.

A moving space for elastic deformation of the elastic part may be formed between the elastic part and the extension part.

An upper surface of the fixing part and an upper surface of the fixing groove may be formed inclined.

A mounting member protruding to the inside of the door dike may be provided at an inner surface of the door dike. The guide groove and the fixing groove may be formed in the mounting member.

The mounting member may be integrally injection-molded with the door dike.

The mounting member may be detachably provided to the inner surface of the door dike.

The mounting member may include: a first body protruding from a front end portion of the inner surface of the door dike; and a second body protruding from the inner surface of the door dike, the second body being located at a rear side of the first body, the second body having at least one portion spaced apart from the first body. The guide groove may be formed in a space between the first body and the second body, which are space apart from each other.

The guide groove may be opened upwardly such that the restricting member is inserted into the guide groove.

The refrigerator according to the present disclosure has advantageous effects as follows.

First, the selective restriction of the receiving member and the release of the restriction of the receiving member are possible through a rotating manipulation in a state in which the receiving member is mounted, and the mounting height of the receiving member can be easily controlled by vertically moving the receiving member in the state in which the restriction of the receiving member is released. In this case, the restricting member provided at a side surface of the receiving member includes the elastic part that is elastically deformable and provides an elastic force such that the fixing part is inserted into the fixing groove. Thus, when a user vertically moves the receiving member and then releases the receiving member, the fixing part is easily inserted into the fixing groove by the elastic force of the elastic part, so that it is unnecessary to perform a separate operation of the user so as to restrict the receiving member, thereby improving user convenience.

Second, if the fixing part is located at a position corresponding to the fixing groove by the elastic force of the elastic part even when the user misses the receiving member in the state in which the restriction of the receiving member is released by rotating the receiving member, the fixing part can be inserted into the fixing groove. Thus, it is possible to prevent decay of foods and injury of the user due to the drop of the receiving member, thereby improving use stability.

Third, even in the state in which the fixing part is completely inserted into the fixing groove, the elastic part is in contact with an inner surface of the guide groove to allow the receiving member to be forcibly rotated in a direction in which the fixing part is inserted into the fixing groove. Thus, the rocking of the receiving member can be effective prevented even when the door is opened or when foods stored in the receiving member is introduced/withdrawn, and the state in which the fixing part is inserted into the fixing groove can be stably maintained, thereby improving the stability in use of the receiving member.

Fourth, the upper surface of the fixing part and the upper surface of the fixing groove are formed inclined, so that the fixing part can be easily inserted into or separated from the inside of the fixing groove.

Fifth, the restricting member further include the extension part that connects the rotational center part and the fixing part, and the extension part is in surface contact with the inner surface of the fixing groove. Thus, the durability of the restricting member can be improved such that an external force applied to the rotational center part and the fixing part can be dispersed by the extension part, and the movement of the receiving member can be effectively prevented by the surface contact of the extension part.

DETAILED DESCRIPTION OF THE EMBODIMENTS

Hereinafter, exemplary embodiments of the present disclosure will be described in detail with reference to the accompanying drawings. However, the spirit of the present disclosure is not limited to the suggested embodiments, but those skilled in the art to which the present disclosure pertains can suggest another retrogressive invention or another embodiment which falls within the spirit of the present disclosure through addition, modification, and deletion of another component without departing from the spirit of the present disclosure.

Figure 1:
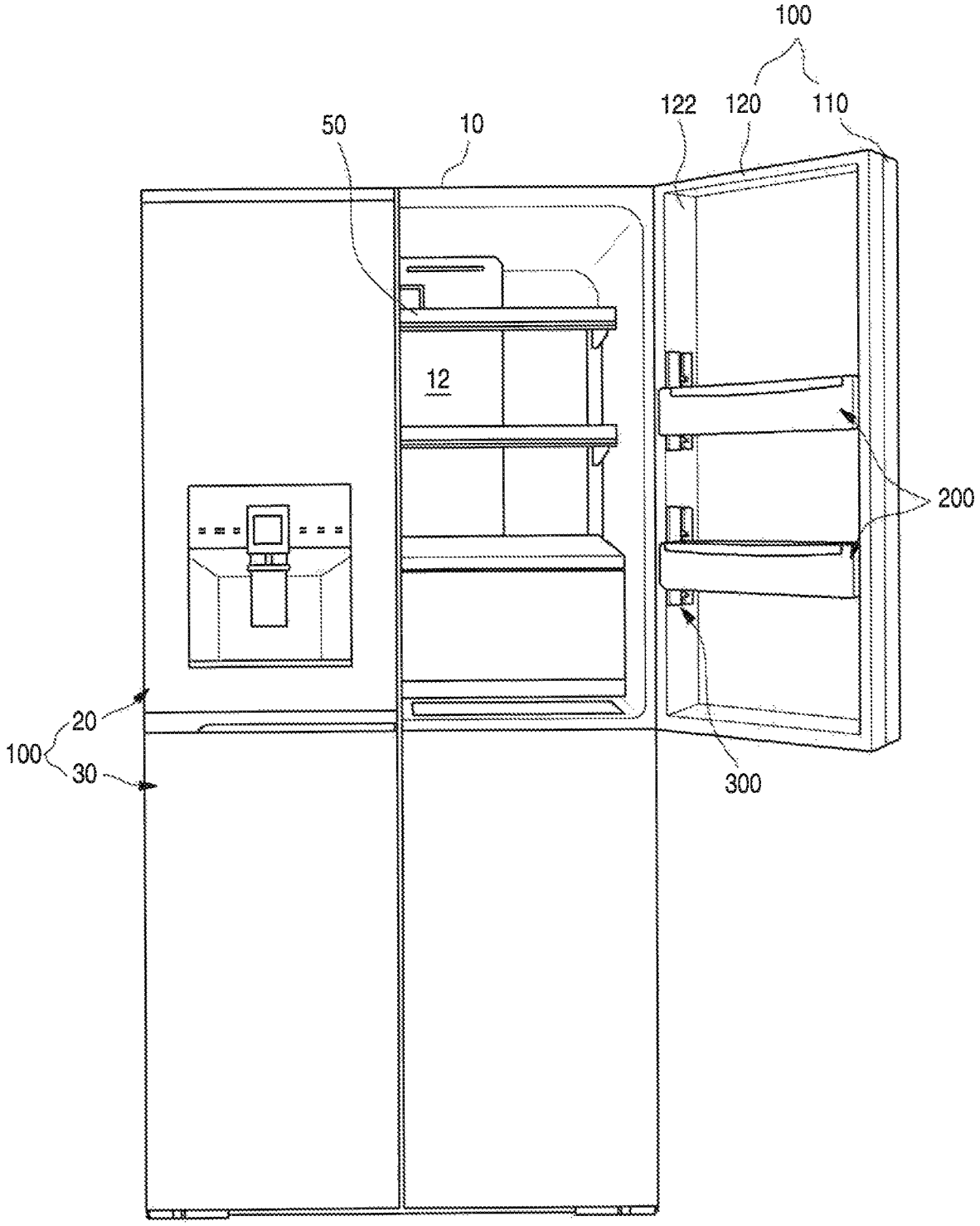
FIG. 1 is a perspective view when a door of a refrigerator according to an embodiment of the present disclosure.

FIG. 1 is a perspective view when a door of a refrigerator according to an embodiment of the present disclosure.

As shown in the drawings, an appearance of the refrigerator according to the embodiment of the present disclosure may be formed by a cabinet 10 having a storage space formed therein and a door 100 that opens/closes the storage space.

The storage space may be vertically divided by a barrier. A refrigerating compartment 12 may be formed at an upper portion of the cabinet 10, and a freezing compartment may be formed at a lower portion of the cabinet 10.

In addition, various members for receiving foods, such as shelves 50, drawers, or baskets, may be provided in the storage space.

The door 100 includes a refrigerating compartment door 20 and a freezing compartment door 30. The refrigerating compartment door 20 may allow an opened front surface of the refrigerating compartment 12 to be opened/closed by rotation thereof, and the freezing compartment door 30 may allow an opened front surface of the freezing compartment to be opened/closed by rotation thereof. In addition, the refrigerating compartment door 20 may be provided in a pair of left and right doors to shield the refrigerating compartment 12, and the freezing compartment door 30 may be provided in a pair of left and right doors to shield the freezing compartment.

The overall appearance of the door 100 may be formed by an out case 110 that forms a front surface and a circumferential surface of the door 100 and a door liner 120 that forms a rear surface of the door 100, which corresponds to the inside of the refrigerator.

A plurality of receiving members 200 for receiving foods, such as baskets and dairy corners, may be mounted at the rear surface of the door 100. At least one of the receiving members 200 may be provided such that its vertical height of the receiving member 200 can be controlled in a state in which it is mounted at the door 100.

The receiving member 200 may employ various structures capable of receiving foods and being mounted at the door 100. Hereinafter, a case where the receiving member 200 is a basket having an opened upper surface will be described as an example.

Meanwhile, a door dike 122 protruding rearward along the circumference of the door line 120 may be formed at the door liner 120. The door dike 122 may be formed in a shape protruding rearward along the circumference of the rear surface of the door 100.

The distance between both side surfaces of the door dike 122, which face each other, may be formed to correspond to the horizontal width of the receiving member 200. In addition, the door dike 122 may protrude to surround at least portions of both left and right side surfaces of the receiving member 200. In detail, the door dike 122 may protrude corresponding to the length of a latter half portion of the receiving member 200 in the front-rear direction so as to surround latter half portions of both the left and right side surfaces of the receiving member 200.

In addition, a mounting member 300 for mounting the receiving member 200 may be provided at an inner surface of the door dike 122. The receiving member 200 may be provided to the mounting member 300, to be moved vertically and fixed. Hereinafter, a coupling structure of the receiving member 200 and the mounting member 300 will be described in detail with reference to the accompanying drawings.

Figure 2:
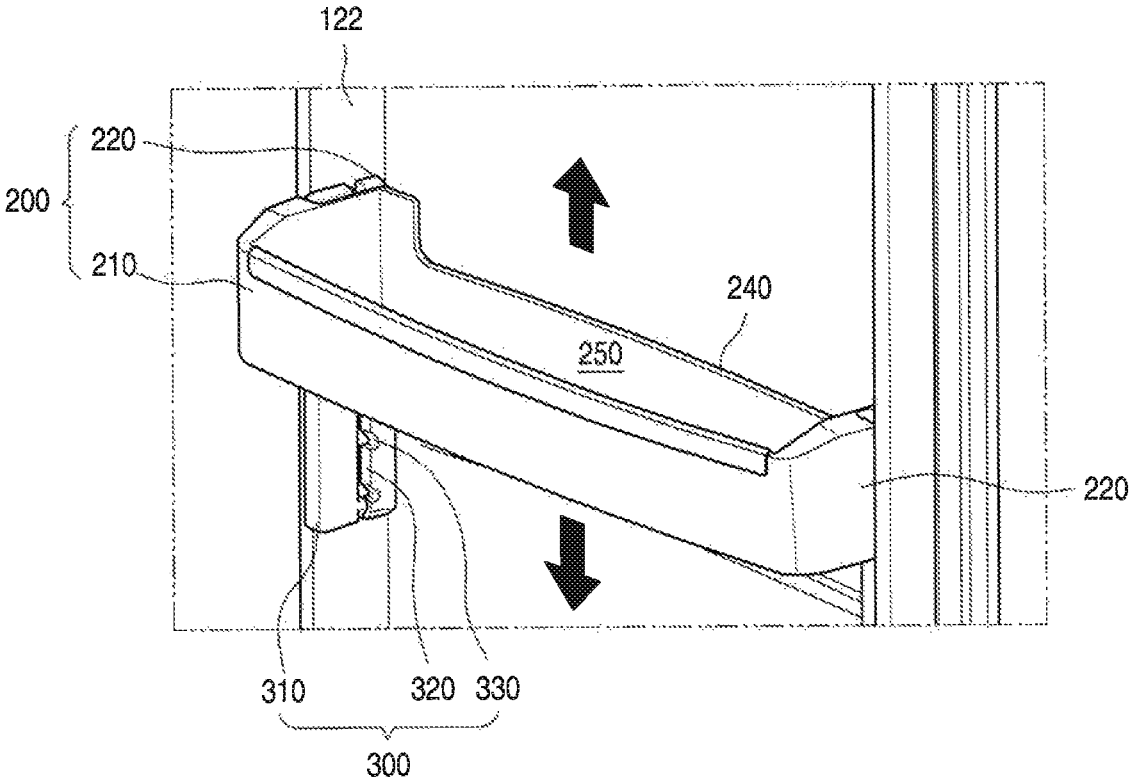
FIG. 2 is a perspective view illustrating a coupling structure of a receiving member and the door according an embodiment of the present disclosure.
Figure 3:
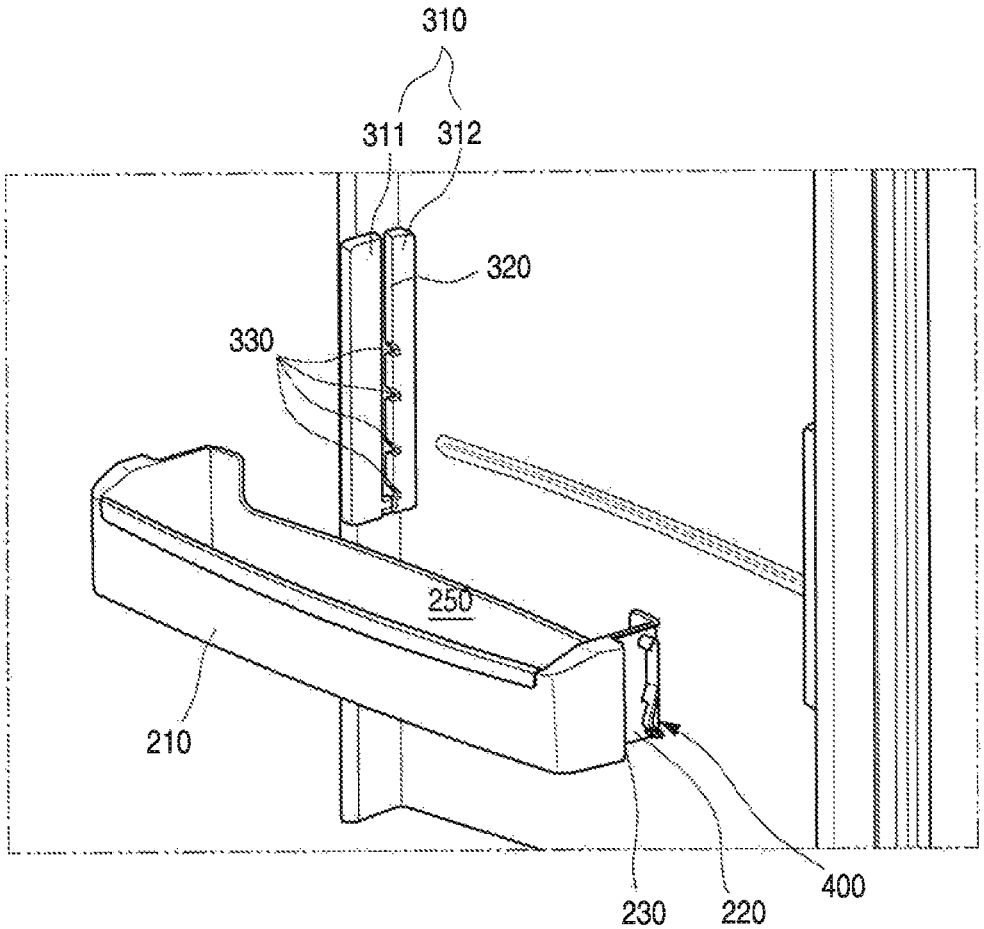
FIG. 3 is an exploded perspective view of the receiving member and the door.

FIG. 2 is a perspective view illustrating a coupling structure of the receiving member and the door according an embodiment of the present disclosure. FIG. 3 is an exploded perspective view of the receiving member and the door.

The mounting member 300 may be provided at left and right inner surfaces of the door dike 122, which face each other. In addition, the mounting member 300 may be provided to protrude from an inner surface of the door dike 122, and be integrally injection-molded together with the door dike 122. It will be apparent that the mounting member 300 may have a structure formed separately from the door dike 122 to be mounted to the door dike 122. However, hereinafter, a structure in which the mounting member 300 is integrally formed with the door dike 122 will be described in detail as an embodiment.

The mounting member 300 may be formed vertically long at the door dike 122 or be provided in plurality such that a plurality of receiving members 200 can be mounted thereto.

Meanwhile, the receiving member 200 may be provided to form a receiving space 250 opened upwardly to accommodate foods therein. Also, the receiving member 200 may be formed of a transparent or translucent material to enable a user to check foods received therein.

In addition, the receiving member 200 may be formed to include a first half portion 210 protruding to the front of the door dike 122 (when viewed in FIG. 2) when the receiving member 200 is mounted to the door 100, and a latter half portion 220 located at the inside of the door dike 122, the latter half portion 220 being in contact with the rear surface of the door and an inner surface of the mounting member 300.

The width of the first half portion 210 in the lateral direction may be formed wider than that of the latter half portion 220 in the lateral direction. In addition, a stepped part 230 may be formed at a portion at which the first half portion 210 and the rear half portion 220 are in contact with each other.

The stepped part 230 may be provided at a front end portion of the mounting member 300, to prevent horizontal and vertical movements of the receiving member 200. To this end, the width of the first half portion 210 in the lateral direction may be larger than the distance between a pair of mounting members 300 respectively provided at both left and right side surfaces of the door dike 122. In addition, the width of the latter half portion 220 in the lateral direction may be formed to correspond to the distance between the pair of mounting members 300 respectively provided at both the left and right side surfaces of the door dike 122 such that the latter half portion 220 is inserted between the pair of mounting members 300.

It will be apparent that the first half portion 210 may be formed to have a width larger than the distance between both the left and right side surfaces of the door dike 122 such that the stepped part 230 is in contact with the front end of the door dike 122.

Meanwhile, a rear surface of the receiving member 200 may be supported in contact with the rear surface of the door 100 in the state in which the receiving member 200 is mounted to the mounting member 300. In this case, a cut-out part 240 recessed downwardly from an upper end of the receiving member 200 may be formed at the rear surface of the receiving member 200. The cut-out part 240 may be formed as a portion of the rear surface of the receiving member 200 is cut out, and allows the contact area between the rear surface of the receiving member 200 and the rear surface of the door to be decreased. Thus, it is possible to prevent the occurrence of dew condensation caused by a difference in temperature between the rear surface of the door 100 and the rear surface of the receiving member 200.

A restricting member 400 may be provided to protrude from each of both side surfaces of the latter half portion 220. The restricting member 400 is moved vertically at the inside of a guide groove 320 of the mounting member 300, and is selectively inserted into a fixing groove 330 to be fixed to the fixing groove 330.

Meanwhile, the mounting member 300 may include a body 310 protruding from the inner surface of the door dike 122.

In addition, the guide groove 320 that is formed recessed vertically long and the fixing groove 330 that is recessed at one side of the guide groove 320 and communicates with the guide groove 320 may be formed in an inner surface of the body 310.

The body 310 may be provided to protrude from the inner surface of the door dike 122, and extend vertically long. In addition, the body 310 may be formed to have a front-rear length corresponding to that to which the door dike 122 protrudes such that the front end of the body 310 is located on the same line as the front end of the door dike 122.

The guide groove 320 restricts the restricting member 400 to be movable vertically, so that the receiving member 200 is restricted to be movable vertically. The guide groove 320 may be formed recessed vertically long at the center of the inner surface of the body 310 in the lateral direction. Thus, the restricting member 400 is restricted between front and rear surfaces of the guide groove 320 in the state in which the restricting member 400 is inserted into the guide groove 320. Accordingly, the restricting member can be moved vertically without being separated from the guide groove 320.

In more detail, the body 310 may include a first body 311 located at a front end portion of the door dike 122, and a second body 312 located at a rear end portion of the door dike 122, the second body 312 have at least a portion spaced apart from the first body 311. In addition, the guide groove 320 may be defined as a region between the first body 311 and the second body 312, which are spaced apart from each other. In addition, the restricting member 400 may be restricted to a rear end of the first body 311 in the state in which the restricting member 400 is inserted into the guide groove 320 not to be separated to the front of the body 310.

Meanwhile, the guide groove 320 may be formed by a length to which the receiving member 200 is movable in the top-bottom direction. Also, the guide groove 320 may be formed to have an opened upper end such that the restricting member 400 can be inserted into the guide groove 320 through the opened upper end of the guide groove 320. Thus, the user inserts the restricting member 400 into the guide groove 320 through the opened upper end of the guide groove 320, so that the receiving member 200 can be mounted to the mounting member 300.

Meanwhile, the fixing groove 330 may allow one side of the restricting member 400 to be selectively inserted and fixed therein by rotation of the receiving member 200, so that the receiving member 200 can be fixed. To this end, the fixing groove 330 may be formed recessed toward the rear surface of the door 100 from an inner surface of the guide groove 320. In more detail, the guide groove 320 may be formed recessed from the front end toward the guide groove 320 of the second body 312.

In addition, a plurality of fixing grooves 330 may be formed in the second body 312 to be vertically spaced apart from each other. Thus, the restricting member 400 is selectively inserted into any one of the plurality of fixing grooves 330, so that the receiving member 200 can be fixed at a desired height. In this case, the fixing grooves 330 may be consecutively formed at a certain distance in the top-bottom direction in a region between upper and lower ends of the guide groove 320.

That is, the fixing groove 330 may be formed in plurality spaced apart from each other along the guide groove 320, and extend in a direction intersecting the guide groove 320.

Figure 4:
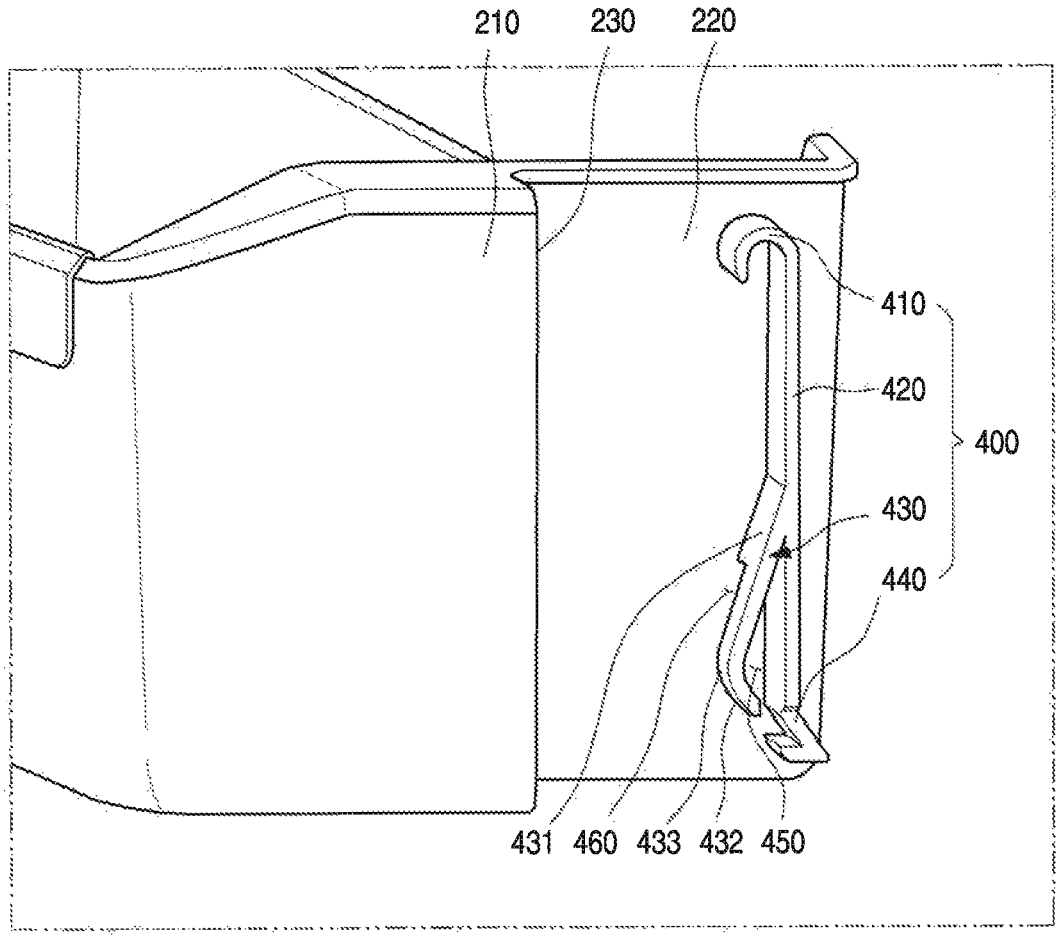
FIG. 4 is a partial enlarged view of the receiving member, illustrating a detailed structure of a restricting member.
Figure 5:
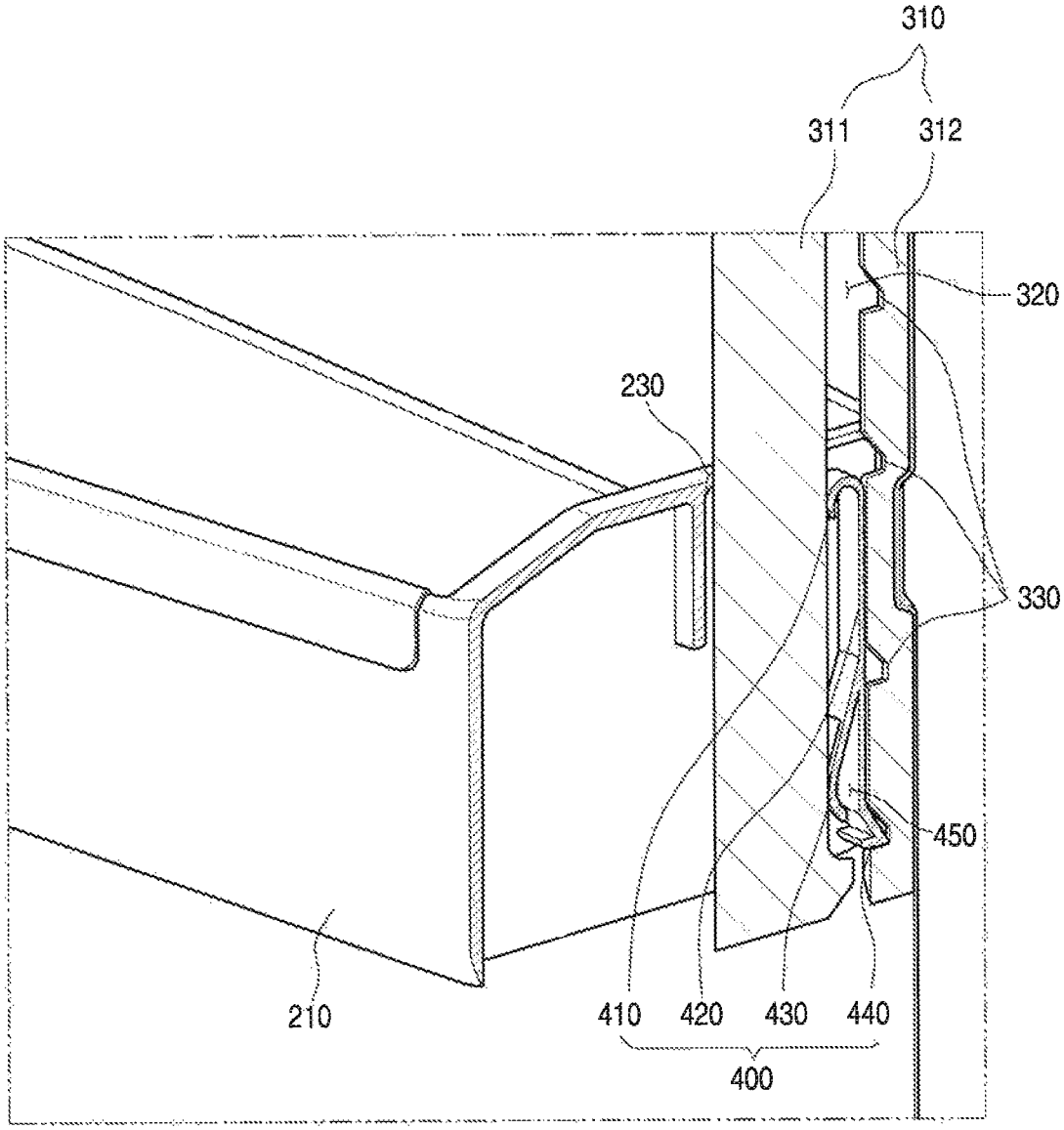
FIG. 5 is a partial cut-out perspective view illustrating in detail a coupling structure of the restricting member and a mounting member.

FIG. 4 is a partial enlarged view of the receiving member, illustrating a detailed structure of the restricting member. FIG. 5 is a partial cut-out perspective view illustrating in detail a coupling structure of the restricting member and a mounting member.

The restricting member 400 may be provided at each of both the side surfaces of the latter half portion of the receiving member 200, and be integrally formed with the receiving member 200. It will be apparent that the restricting member 400 may be provided as a separate member to be mounted to the receiving member 200. However, hereinafter, a case where the restricting member 400 and the receiving member 200 are integrally formed will be described in detail as an embodiment.

The restricting member 400 may include a rotational center part 410 that becomes a rotational center of the receiving member 200 in rotation of the receiving member 200, an extension part 420 extending downwardly from the rotational center part 410, a fixing part 440 selectively inserted into the fixing groove 330 by rotation of the receiving member 200, and an elastic part 430 allowing the receiving member 200 to be forcibly rotated in a direction in which the fixing part 440 is inserted into the fixing groove 330.

The rotational center part 410 may be formed to protrude from an upper portion of an outer surface of the latter half portion 220. Also, the rotational center part 410 may be formed to have a width in the front-rear direction, corresponding to that of the guide groove 320 in the front-rear direction, to stably serve as a rotation axis without being moved in the front-rear direction in the state in which the rotational center part 410 is inserted into the guide groove 320. Also, the rotational center part 410 may be formed rounded such that a portion in contact with the inner surface of the guide groove 320 has a certain curvature in rotation of the restricting member 400. It will be apparent that the rotational center part 410 may be formed to have a circular section having a diameter corresponding to the width of the guide groove 320 in the front-rear direction.

The extension part 420 may be formed to protrude vertically long from the outer surface of the latter half part 220. In addition, an upper end of the extension part 420 may extend to a lower end of the rotational center part 410. That is, the extension part 420 may be formed in a shape extending downwardly from the lower end of the rotational center part 410. In this case, the width of the extension part 420 in the front-rear direction may be formed narrower than that of the guide groove 320 in the front-rear direction. Thus, the restricting member 400 can be rotated at the inside of the guide groove 320.

In addition, a rear surface of the extension part 420 may be provided to be in surface contact with a front surface of the second body 312.

The fixing part 440 may be formed to protrude from a lower portion of the outer surface of the latter half part 220. The fixing part 440 may be formed to protrude rearward of the rear surface of the extension part 420, to be inserted and fixed in the fixing groove 330 when the rear surface of the extension part 420 is in contact with the front surface of the second body 312.

The fixing part 440 may be formed to extend from a lower end of the extension part 420. That is, the extension part 420 may be formed in a shape connecting the rotational center part 410 and the fixing part 440. The rotational center part 410, the extension part 420, and the fixing part 440 are integrally connected to each other, so that the restricting member 400 can have a high strength without being easily damaged by stress and external impact.

In addition, an upper surface of the fixing part 440 may be formed downwardly inclined toward the rear thereof, to be easily separated from the fixing groove 330 when the front end of the receiving member 200 is rotated upwardly. In addition, when the user applies a force for upwardly rotating the front end of the receiving member 200, the upwardly applied force can be effectively changed to a rotational force of the receiving member 200 due to the inclined upper surface of the fixing part 440. In this case, an upper surface of the fixing groove 330 may also be formed to have an inclination corresponding to that of the upper surface of the fixing part 440 to stably guide insertion/separation of the fixing part 440 as the receiving member 200 is rotated. That is, the upper surface of the fixing groove 330 may be formed to have an inclination, so that the vertical length of the fixing groove 330 is increased as forwarding toward the guide groove 320.

The elastic part 430 may be provided to be elastically deformable, and allow the receiving member 200 to be forcibly rotated in a direction in which the fixing part 440 is inserted into the fixing groove 330 by an elastic force. That is, the elastic part 430 may provide an elastic force such that the front end of the receiving member 200 is rotated downwardly. Also, the elastic part 430 may continuously provide the elastic force such that the fixing part 440 can maintain an initial state in which the front end of the receiving member 200 is rotated downwardly even when the fixing part 440 is inserted into the fixing groove 330.

The elastic part 430 may be provided to protrude toward a front surface of the guide groove 320 from one side of the extension part 420. In detail, the elastic part 430 may protrude toward a rear surface of the first body 311 from the one side of the extension part 420, and be in contact with the rear surface of the first body 311 to apply the elastic force.

In this case, the portion at which the elastic part 430 is in contact with the rear surface of the first body 311 may correspond to a position spaced apart downwardly from the rotational center part 410. Thus, the elastic part 430 elastically pressurizes the rear surface of the first body 311, so that the front end of the receiving member 200 enables the rotational center part 410 to be forcibly moved downwardly to the center.

Meanwhile, the elastic part 430 may be formed to protrude forwards from a front surface of the extension part 420 and extend downwardly. In addition, at least one portion of the elastic part 430 may be spaced apart from the extension part 420 to permit elastic deformation. That is, a moving space 450 for elastic deformation of the elastic part 430 may be formed between the elastic part 430 and the extension part 420. In order to permit the elastic deformation, the elastic part 430 may be formed such that at least one portion of the elastic part 430 is cut out from a side surface of the receiving member 200. Thus, the elastic part 430 can be elastically deformed as the portion at which the elastic part 430 is in contact with the rear surface of the first body 311 is pressurized when the front end of the receiving member 200 is rotated upwardly.

In more detail, the elastic part 430 may extend downwardly inclined to the front from the front surface of the extension part 420 and then extend downwardly inclined to the rear. That is, the elastic part 430 may include a first part 431 extending downwardly inclined to the front from the front surface of the extension part 420 and a second part 432 extending downwardly inclined to the rear from an end portion of the first part 431. Also, the elastic part 430 may include a round part formed rounded at a portion at which the first part 431 and the second part 432 are in contact with each other. Here, the round part 433 is a part maximally protruding to the front, and may be defined as a part that is in contact with the first body 311.

In addition, as an upper end of the elastic part 430 extends from the front surface of the extension part 420, the upper end of the elastic part 430 may be in a state in which it is fixed to the front surface of the extension part 420. In addition, a lower end of the elastic part 430 may be in a state in which it is spaced apart from the extension part 420 in the front-rear direction so as to permit the elastic deformation. In addition, a side surface of the elastic part 430 may be provided to be cut out from the side surface of the receiving member 200. That is, the elastic part 430 may be spaced apart from the side surface of the receiving member 200 to form a space part 460.

Meanwhile, although both of the upper and lower ends of the elastic part 430 are integrally formed in contact with the extension part 420, the elastic deformation of the elastic part 430 may be performed by the moving space 450. Therefore, both of the upper and lower ends of the elastic part 430 may be integrally formed in contact with the extension part 420.

Figure 6:
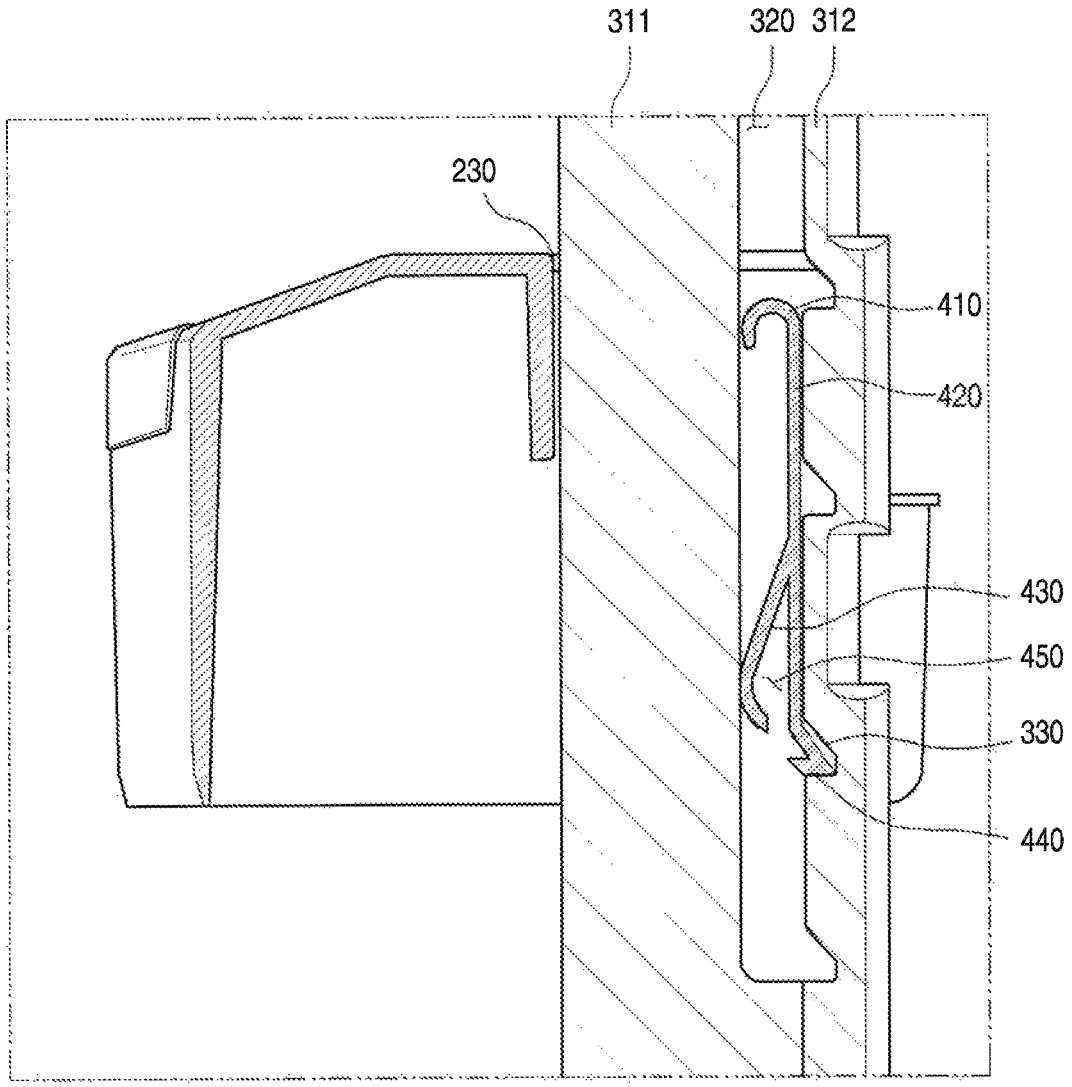
FIG. 6 is a cut-out view illustrating in detail a structure of the restricting member and the mounting member in an initial state in which the receiving member is fixed.
Figure 7:
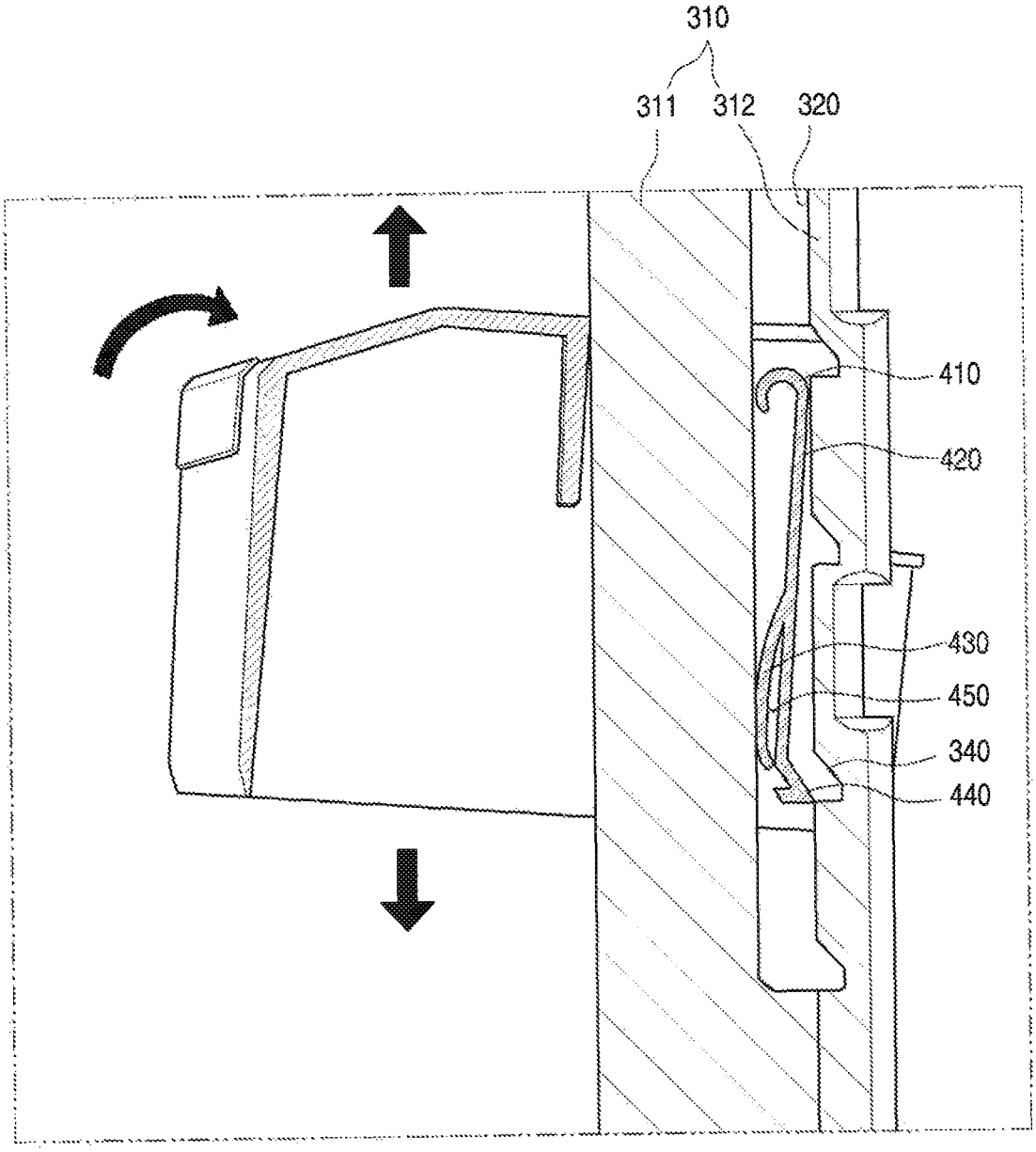
FIG. 7 is a cut-out view illustrating a structure of the restricting member and the mounting member in a state in which the front end of the receiving member is rotated upwardly.
Figure 8:
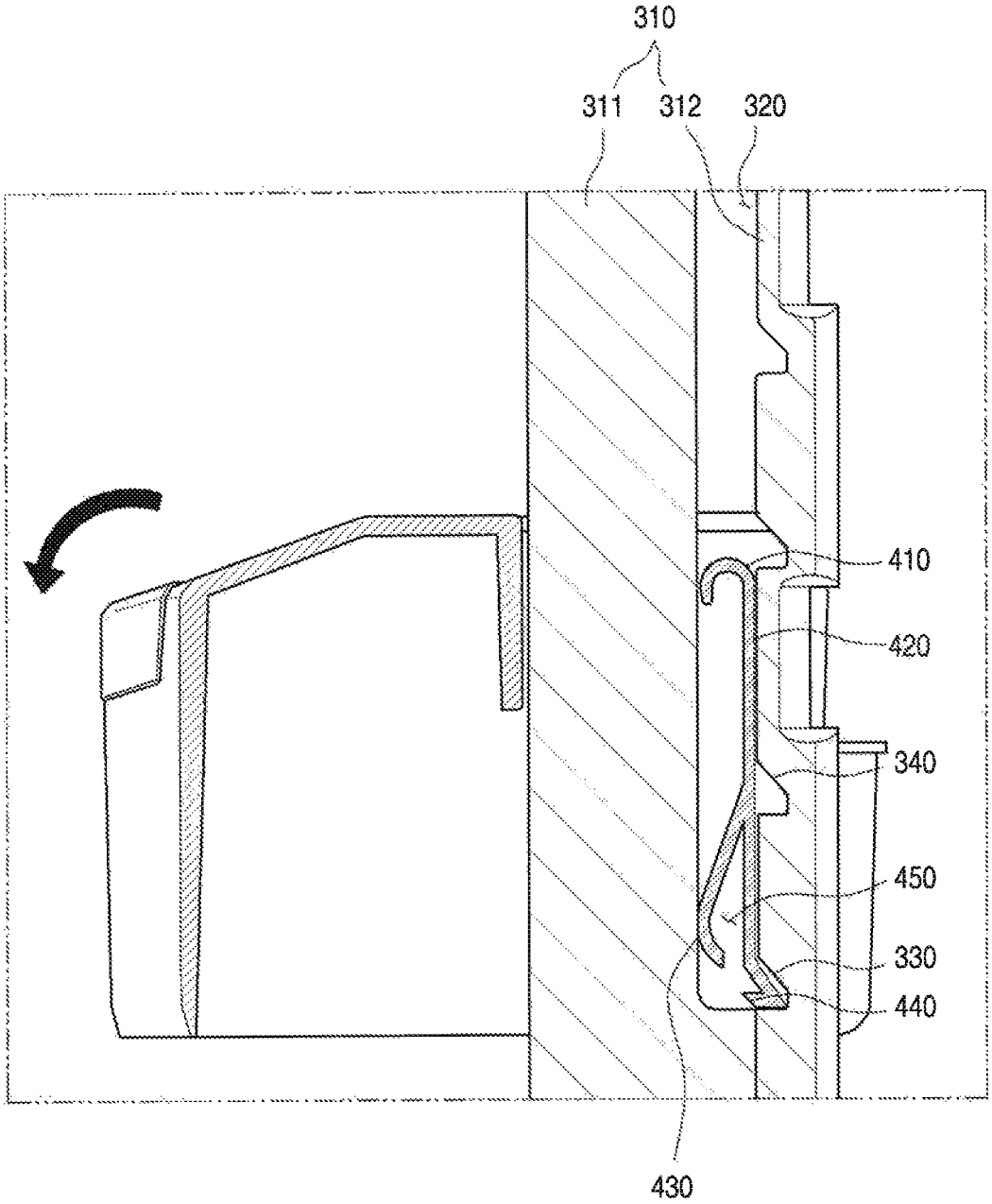
FIG. 8 is a cut-out view illustrating a structure of the restricting member and the mounting member in a state in which the receiving member is moved downwardly.

FIG. 6 is a cut-out view illustrating in detail a structure of the restricting member and the mounting member in an initial state in which the receiving member is fixed. FIG. 7 is a cut-out view illustrating a structure of the restricting member and the mounting member in a state in which the front end of the receiving member is rotated upwardly. FIG. 8 is a cut-out view illustrating a structure of the restricting member and the mounting member in a state in which the receiving member is moved downwardly.

Hereinafter, an interaction between the restricting member and the mounting member according to rotation of the receiving member 200 will be described in detail with reference to the accompanying drawings.

Referring to FIG. 6, in the state in which the front end of the receiving member 200 is rotated downwardly to be fixed, the fixing part 440 is in a state in which it is inserted into the fixing groove 330. Thus, the receiving member 200 is in a state in which it is fixed without being moved vertically.

In addition, the rear surface of the extension part 420 is in a state in which it is in contact with the front surface of the second body 312. Thus, the receiving member 200 is prevented from being moved in the front-rear direction, to be stably fixed.

In addition, the elastic part 430 may be provided to be in contact with the rear surface of the first body 11 and continuously apply the elastic force to the rear surface of the first body 11. Thus, the fixing part 440 can maintain a state in which it is stably inserted into the fixing groove 330 by the elastic force of the elastic part 430 without being easily separated from the fixing groove 330. Accordingly, although external impact is applied to the receiving member 200 or although interference occurs due to introduction/withdrawal of foods, the receiving member 200 can stably maintain the fixed state without being moved.

Meanwhile, as the elastic coefficient of the elastic part 430 is increased, the fixed state of the receiving member 200 may be maintained. As the elastic coefficient of the elastic part 430 is decreased, a rotating manipulation of the receiving member 200 can be more easily performed.

Referring to FIG. 7, when the user upwardly lifts the front end of the receiving member 200 to permit a vertical movement of the receiving member 200, the front end of the receiving member 200 is rotated using the rotational center part 410 as a rotation axis.

In addition, the fixing part 440 may be separated from the fixing groove 330 to be located at the inside of the guide groove 320. That is, if the front end of the receiving member 200 is rotated upwardly, the restricting part 400 may be entirely located at the inside of the guide groove 320. Thus, the receiving member 200 can be moved vertically.

In this case, the elastic part 430 may be pressurized to be elastically deformed such that the width of the moving space 450 in the front-rear direction is narrowed. That is, if the front end of the receiving member 200 is rotated upwardly, the width of the moving space in the front-rear direction is narrowed by the elastic deformation of the elastic part 430. In addition, as a lower end of the restricting member 400 is rotated to the front about the rotational center part 410, the fixing part 440 located at a lower end portion of the restricting member 400 is moved to the front, to be separated from the guide groove 320.

Meanwhile, the elastic part 430 continuously provides the elastic force such that the front end of the receiving member 200 is rotated downwardly. Thus, when the receiving member 200 is moved vertically and then released in the state in which the front end of the receiving member 200 is rotated upwardly, the fixing part 440 can be stably inserted into the fixing groove 330 by the elastic force of the elastic part 430.

In addition, if the fixing part 440 is located at a position corresponding to the fixing groove 330 by the elastic force of the elastic part 430 even when the user misses the receiving member 200 while vertically moving the receiving member 200, the fixing part is inserted and fixed in the fixing groove 330. Thus, it is possible to prevent damage caused by drop of the receiving member 200 and decay of foods.

Referring to FIG. 8, if the user places the fixing part 440 in the fixing groove 330 at a desired height by downwardly moving the receiving member 200 and the releases the receiving member 200, the front end of the receiving member 200 is rotated downwardly by the elastic force of the elastic part 430. In addition, the fixing part 440 is inserted into the fixing groove 330, to fix the receiving member 200 such that the receiving member 200 is not moved vertically.

In addition, the elastic part 430 continuously provides the elastic force such that the front end of the receiving member 200 can maintain the initial state in which the front end of the receiving member 200 is rotated downwardly even when the fixing part 440 is inserted into the fixing groove 330. Thus, although a predetermined external force is applied to the receiving member 200 due to external impact or use of the receiving member 200, the fixing part 440 can maintain the state in which it is stably inserted into the fixing groove 330 by the elastic force of the elastic part 430. Furthermore, it is possible to prevent receiving member 200 from dropping as the fixing part 440 is arbitrarily separated from the fixing groove 330. Accordingly, the user can easily perform the vertical movement of the receiving member 200, and feel a sense of security as the receiving member 200 is stably fixed.

Although some embodiments of the present disclosure are described for illustrative purposes, it will be apparent to those skilled in the art that various modifications and changes can be made thereto within the scope of the disclosure without departing from the essential features of the disclosure.

Accordingly, the aforementioned embodiments should be construed not to limit the technical spirit of the present disclosure but to be provided for illustrative purposes so that those skilled in the art can fully understand the spirit of the present disclosure.

The scope of the present disclosure should not be limited to the aforementioned embodiments but defined by appended claims. The technical spirit within the scope substantially identical with the scope of the present disclosure will be considered to fall in the scope of the present disclosure defined by the appended claims.

What is claimed is:

1. A refrigerator comprising:

a cabinet that defines a storage space;

a door configured to open and close at least a portion of the storage space;

a door dike protruding from a rear surface of the door toward the storage space along a circumference of the rear surface of the door;

a guide groove defined at an inside surface of the door dike, the guide groove extending in a vertical direction with respect to a bottom of the cabinet;

a plurality of fixing grooves recessed from a first inner surface of the guide groove and vertically spaced apart from each other, each of the plurality of fixing grooves extending in a direction intersecting the guide groove;

a receiving member configured to mount to the door dike, the receiving member being movable in the vertical direction and being rotatable about an axis perpendicular to the inside surface of the door dike; and a restricting member that is located at an outside surface of the receiving member, the restricting member being configured to move along the guide groove, wherein the restricting member comprises:

a rotational center part protruding from the outside surface of the receiving member and configured to insert into the guide groove, the receiving member being rotatable about the rotational center part, a fixing part protruding from the outside surface of the receiving member and vertically spaced apart from the rotational center part, the fixing part being configured to selectively insert into a fixing groove among the plurality of fixing grooves based on the receiving member rotating about the rotational center part, an extension part that has a rib shape, that connects the rotational center part to the fixing part, and that extends in the vertical direction from an upper end connected to the rotational center part to a lower end connected to the fixing part, and an elastic part protruding toward a second inner surface of the guide groove opposite the first inner surface of the guide groove, the elastic part being configured to elastically deform based on the receiving member rotating about the rotational center part, deformation of the elastic part providing an elastic force that causes the fixing part to insert into the fixing groove, wherein the elastic part extends from one side of the extension part in a direction away from the rotation center part, the elastic part having an end portion spaced apart from the fixing part.

2. The refrigerator of claim 1, wherein the elastic part is configured to be pressed by the second inner surface of the guide groove based on the fixing part being received by the fixing groove.

3. The refrigerator of claim 1, wherein the elastic part is configured to elastically deform by being pressed by the second inner surface of the guide groove based on the receiving member rotating about the rotating center part, and wherein the fixing part is configured to separate from the fixing groove based on the elastic part being elastically deformed to a predetermined position.

4. The refrigerator of claim 1, wherein the rotational center part is located vertically above the fixing part.

5. The refrigerator of claim 1, wherein the extension part is configured to be in surface contact with the first inner surface of the guide groove based on the fixing part being received by the fixing groove.

6. The refrigerator of claim 1, wherein the elastic part protrudes from a front surface of the extension part and extends downwardly toward the second inner surface of the guide groove, and wherein the end portion of the elastic part is closer to the fixing part than to the rotational center part.

7. The refrigerator of claim 6, wherein the elastic part includes:

a first part protruding from the front surface of the extension part and inclined downwardly toward the second inner surface of the guide groove;

a second part extending from a lower end of the first part and inclined downwardly toward the first inner surface of the guide groove; and a round part connecting the first and second parts, the round part being configured to contact the second inner surface of the guide groove.

8. The refrigerator of claim 6, wherein the elastic part has a rib shape and at least a portion of the elastic part is spaced apart from the outside surface of the receiving member to define a space between the elastic part and the outside surface of the receiving member.

9. The refrigerator of claim 6, wherein the elastic part and the extension part define a moving space therebetween, and wherein the moving space becomes narrower based on the elastic part being elastically deformed.

10. The refrigerator of claim 7, wherein a lower end of the second part of the elastic part is spaced apart from the front surface of the extension part.

11. The refrigerator of claim 1, wherein the fixing part has an upper surface that slopes relative to the first inner surface of the guide groove, and wherein the fixing groove has an upper surface that slopes relative to the first inner surface of the guide groove.

12. The refrigerator of claim 1, further comprising a mounting member that protrudes from the inside surface of the door dike, the mounting member defining the guide groove and the fixing groove.

13. The refrigerator of claim 12, wherein the mounting member and the door dike are integrally formed by injection molding.

14. The refrigerator of claim 12, wherein the mounting member is detachably coupled to the inside surface of the door dike.

15. The refrigerator of claim 12, wherein the mounting member includes:

a first body protruding from a first portion of the inside surface of the door dike; and a second body protruding from a second portion of the inside surface of the door dike, the second portion being closer to the rear surface of the door than the first portion, wherein at least a portion of the second body is spaced apart from the first body such that the guide groove is defined in a space between the first body and the second body.

16. The refrigerator of claim 15, wherein the mounting member defines an opening at an upper end of the guide groove, the restricting member being configured to insert into the guide groove through the opening.

17. The refrigerator of claim 15, wherein the second body defines the plurality of fixing grooves.

18. The refrigerator of claim 1, wherein at least a portion of the receiving member protrudes toward the storage space relative to the door dike based on the receiving member mounting to the door dike.

19. The refrigerator of claim 1, wherein the rotational center part has a curved section, and wherein at least a portion of the rotational center part contacts the second inner surface of the guide groove based on the receiving member rotating about the rotational center part.

20. The refrigerator of claim 1, wherein the restricting member is integrally formed with the receiving member.

* * * * *